United States Patent [19]

Ennis

[11] Patent Number: 4,943,017

[45] Date of Patent: Jul. 24, 1990

[54] FLEXIBLE CONTAINER HOLDER WITH INTEGRAL HANDLES

[76] Inventor: John W. Ennis, 6049 Balboa Cir., #202, Boca Raton, Fla. 33433

[21] Appl. No.: 299,657

[22] Filed: Jan. 23, 1989

[51] Int. Cl.[5] ..... A47D 15/00

[52] U.S. Cl. ..... 248/102; 215/100 A; 220/94 R

[58] Field of Search ..... 248/102; 215/100 A; 220/94 R, 96, 85 D, 85 E

[56] References Cited

U.S. PATENT DOCUMENTS

| | | | |
|---|---|---|---|
| 871,622 | 11/1907 | Pettee | 248/102 |
| 1,496,066 | 6/1924 | Meyer | 215/100 A |
| 1,617,213 | 2/1927 | La Paugh | 248/102 X |
| 2,033,296 | 3/1936 | Porter | 248/102 |
| 2,733,883 | 2/1956 | Gourley | 248/102 |
| 2,789,002 | 4/1957 | Nicholas | 248/102 X |
| 3,058,708 | 10/1962 | Murray et al. | 248/102 |
| 3,773,287 | 11/1973 | Hechinger | 248/102 |
| 3,990,596 | 11/1976 | Hoffman | 215/100 A X |
| 4,116,374 | 9/1978 | Garello | 215/100 A X |
| 4,655,715 | 4/1987 | Van de Carr et al. | 248/102 X |

FOREIGN PATENT DOCUMENTS

| | | | |
|---|---|---|---|
| 1433209 | 4/1976 | United Kingdom | 215/100 A |

*Primary Examiner*—David L. Talbott
*Attorney, Agent, or Firm*—Dykema Gossett

[57] ABSTRACT

A flexible container holder or grasping aid is disclosed that will aid an infant or an invalid in grasping a fluid container. The flexible container holder is a one-piece item with two opposed handle portions and an intermediate central portion for tightly receiving a fluid container. The intermediate central portion is flexible and will deform to accommodate any profile of fluid container. The device is formed of a tough rubber and thus will not be easily destroyed by an infant. The handle portions are of a relatively great thickness compared to the intermediate central portion. This allows the intermediate central portion to be easily deformable while the handle portions will still provide firm support for the fluid container.

5 Claims, 1 Drawing Sheet

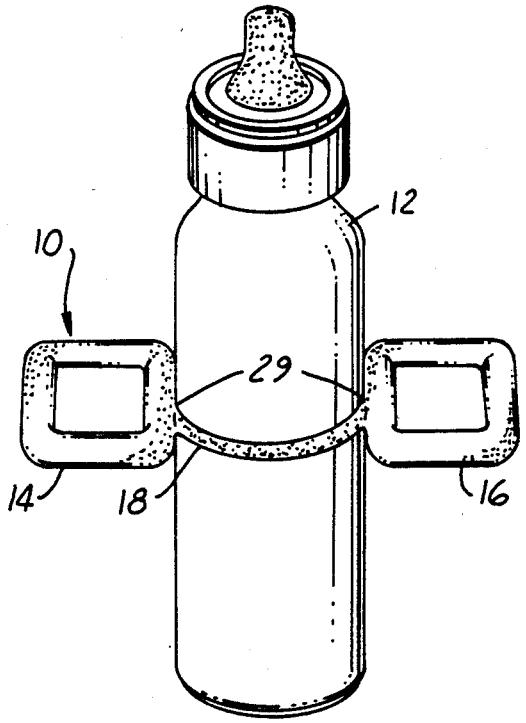
FIG.1
FIG.2
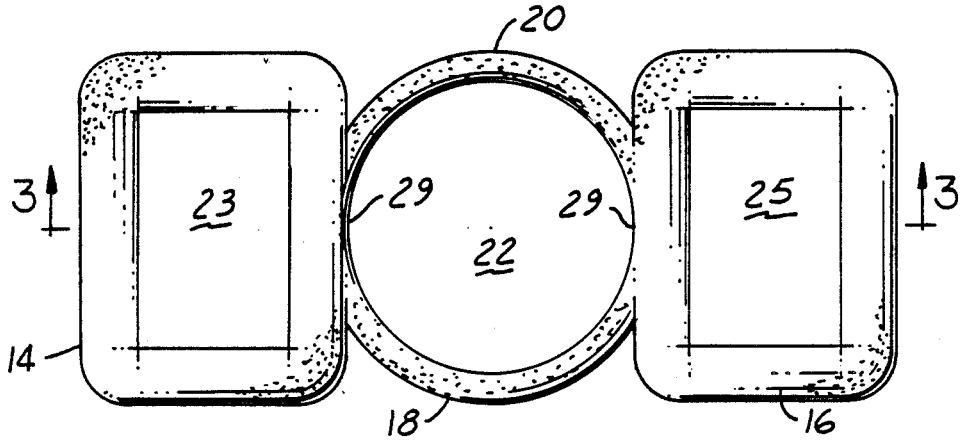
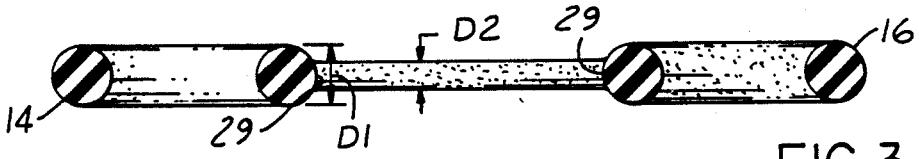
FIG.3
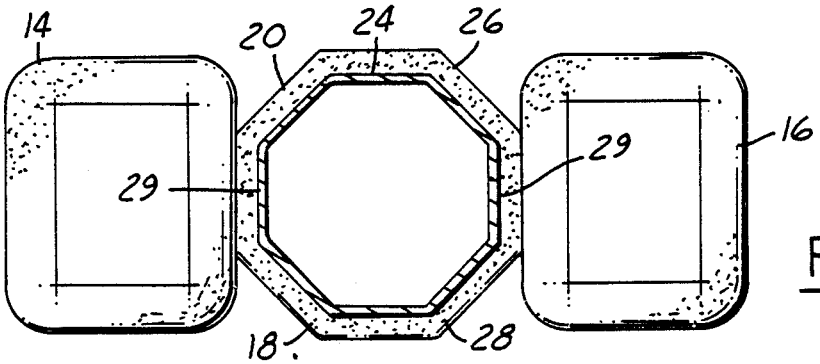
FIG.4

FLEXIBLE CONTAINER HOLDER WITH INTEGRAL HANDLES

BACKGROUND OF THE INVENTION

This invention in general relates to a grasping aid that allows an infant or an invalid to securely hold a fluid container, such as a bottle or the like.

Infants, or invalids who may not have complete use of their hands, may often have difficulty securely grasping a fluid container such as a bottle or the like. The hands of the infant may not be of sufficient size to securely hold the milk bottle since it will be of a relatively great diameter with respect to the infant's hand.

Any device that is to be used by an infant must be child-proof and must be relatively sturdy. In addition, for any container holder to be practical, it must be adaptable to a variety of shapes of outer peripheries of fluid containers.

It is an object of the present invention to create a flexible container holder or grasping aid that can be utilized by an infant or an invalid to aid in firmly holding a fluid container such as a bottle.

It is further an object of the present invention to achieve such a container holder that is child-proof and which is formed of a tough material.

It is further an object of the present invention to achieve such a container holder that may be utilized with any outer profile of a fluid container.

SUMMARY OF THE INVENTION

The present invention discloses a one-piece, flexible container holder or grasping aid that is utilized in conjunction with a fluid container, such as an infant's bottle, to aid the infant in firmly grasping the bottle.

More particularly, the container holder consists of a removably attached integral member having opposed grasping handle portions and an intermediate central portion for receiving a fluid container. This central receiving portion is quite resilient and thus can adapt itself to the shape of most fluid containers that the device is desired to be utilized with.

The two handle portions that are utilized for grasping are attached to the central portion on opposite sides thereof and have a relatively large cross-section with respect to the central portion. The handle portions having the relatively large cross-section allow the handle portion to provide firm support for the fluid container. The central portion being of a thinner cross-section allows the central portion to be more resilient and thus easily adaptable to various profiles of fluid containers.

The device is preferably formed of a rubber, has an overall circular cross-section, and is molded as a one-piece item.

These and other objects and features of the present invention can best be understood upon a reading of the attached specification and drawings, of which the following is a brief description thereof.

BRIEF DESCRIPTION OF THE DRAWINGS

FIG. 1 is a side view showing the combination of the container holder of the present invention utilized with a standard infant bottle.

FIG. 2 is a top view showing the profile of the container holder of the present invention.

FIG. 3 is a cross-section through the container holder of the present invention along line 3—3 of FIG. 2.

FIG. 4 is a top view showing the container holder of the present invention being utilized with an octagonal-shaped fluid container.

DETAILED DESCRIPTION OF AN EMBODIMENT OF THE INVENTION

The present invention can be best understood upon studying FIG. 1, which shows a container holder 10 made according to the teachings of the present invention mounted upon an infant bottle 12. As can be seen from FIG. 1, the flexible container holder 10 consists of a first handle or grasping portion 14 and a second opposed handle or grasping portion 16 mounted at the exact opposite end of the flexible container holder 10. The handle or grasping portions 14 and 16 are shown to be connected by connecting portion 18 which closely overlies the infant bottle 12.

FIG. 2 shows the overall shape of the flexible container holder 10 of the present invention. As can be seen from FIG. 2, the first handle portion 14 is mounted at one end of the flexible container holder 10, and the second handle portion 16 is mounted opposed, spaced by 180 degrees from the first handle 14. The connection portion 18 can be seen to be semicircular and extending from handle 14 to handle 16. A second connecting section 20 can be seen as also being semicircular and connecting handles 14 and 16 at an opposed position from first connecting portion 18. The combination of connecting portions 18 and 20 form an intermediate receiving space 22 that is shown to be nominally circular. It is to be understood that the overall flexible container holder 10 is formed of a very resilient rubber and a strong bias force would tend to urge connecting portions 18 and 20 back to the shape shown in FIG. 2 if they are deformed out of this nominal semicircular shape. The diameter of receiving space 22 is slightly less than the diameter of the fluid containers that the device is to be used with.

Handle portions 14 and 16 are generally rectangular with spaces 23 and 25 respectively formed within their inner peripheries to accommodate the hands of the infant or person using the flexible container holder 10.

As can be appreciated from FIG. 3, the main portions of the flexible container holder 10 of the present invention all have a circular cross-section. Due to this circular cross-section, there are no sharp edges at all on the device. As shown, the handle portions 14 and 16 have a relatively large cross-section with respect to the connecting portions 18 and 20. Specifically, handle portion 14 is shown as having a cross-section D1, and connecting portion 20 is shown as having a second diameter D2. As can be clearly seen from FIG. 3, D1 is much greater than D2. It is seen as an important feature of this invention that D1 be greater than D2 since D1 must be large enough that the handle portions 14 and 16 support the fluid container 12 and also to be graspable by an infant. These relatively large handles 14, 16 may be also useful as a teething ring. The connecting sections 18 and 20 must be of small enough diameter that these two members can be flexed out of their nominal circular shape so as to accommodate any shape of fluid container.

The thickness or diameter, D1, of handle portions 14 and 16 is much smaller than the diameter of the fluid container 12 that is received within the flexible container holder 10. Due to this, an infant's small hands need only grasp the relatively thin cross-section D1 of the handle portions 14 and 16 in order to firmly grasp a fluid container such as bottle 12. In the absence of a device such as flexible container holder 10, the infant would need to grasp the outer circumference of the fluid container 12 which may be of such great circumference that many infants would find it difficult to firmly hold it.

The use of the flexible container holder 10 of the present invention with a fluid container of other than circular cross-section can be seen with reference to FIG. 4. As seen in FIG. 4, an octagonal-shaped fluid container 24 is received within receiving space 22 of the flexible container holder 10 of the present invention. Handle portions 14 and 16 are seen as remaining on opposed sides of fluid container 24, and connecting sections 18 and 20 can be seen as being deformed to accommodate the octagonal profile of fluid container 24. As shown, connecting portion 20 has adopted a three-sided shape 26 corresponding to the shape of octagonal fluid container 24, and connecting portion 18 has also adopted a similar three-sided shape 28 corresponding to the octagonal shape of fluid container 24.

As can be seen from any one of FIGS. 1–4, the handle portions do have a position 29 where they will contact the fluid container. At the position 29 where the handles merge into connecting portions 18 and 20, the thicker diameter handle portions will contact the fluid container. This provides firm support for the fluid container.

The flexible container holder 10 of this invention is made of a rubber material with a durometer that will allow it to stretch and maintain its position on various shapes of fluid containers.

A flexible container holder has been disclosed that is universally adaptable for use on various profiles of fluid containers. In addition, there are handle portions on the flexible container holder that will assist an infant in grasping the fluid container and can act as teething rings.

A working embodiment of the present invention has been disclosed; however, it is not meant to be limiting to the invention. A worker in the art would realize that certain modifications of the invention can be made without departing from the spirit and scope of the invention. The intended scope of the invention can be best understood from the appended claims.

I claim:

1. A flexible container holder having a centrally located longitudinally extending axis comprising:

a nominally ring-like central portion surrounding said axis and forming a central securing section at the inner periphery of said ring-like central portion for receiving a fluid container, said ring-like central portion being deformable out of a nominal ring shape into various other shapes to conform to the shape of the outer peripheral wall of a particular fluid container; and flexible handle portions integrally connected to said central ring-like portion at opposite sides of said central ring-like portion and lying in a plane perpendicular to said axis, said handle portions being generally rectangular and having spaces at the inner periphery thereof to accommodate the hands of a person who wishes to hold a container with the flexible container holder, said handle portions having a circular cross-section and said ring-like central portion having a circular cross-section, the cross-section of said ring-like central section being of a smaller diameter than the cross-section of said handle portions, said central securing section being bounded over a small arc of the circumference of said ring-like central section by a portion of both of said handle portions.

2. A flexible container holder as recited in claim 1 and further wherein said ring-like central portion and said handle portions are formed from rubber.

3. A container holder comprising an integral, one-piece flexible body with a centrally located longitudinally extending axis and having:

(a) a nominally ring-like central portion surrounding said longitudinally extending axis and forming a central securing section at the inner periphery of said ring-like central portion for receiving a fluid container, said ring-like central portion being deformable out of a nominal ring shape into various other shapes to conform to the shape of the outer peripheral wall of a particular fluid container; and (b) flexible handle portions integrally connected to said central ring-like portion at opposite sides of said central ring-like portion and lying in a plane perpendicular to said longitudinally extending axis, said handle portions being generally rectangular and having spaces at the inner periphery thereof to accommodate the hands of a person who wishes to hold a container with the flexible body, said handle portions having a circular cross-section and said ring-like central portion having a circular cross-section, the cross-section of said ring-like central section being of a smaller diameter than the cross-section of said handle portions, said central securing section being bounded over a small arc of the circumference of said ring-like central section by a portion of both of said handle portions.

4. The container holder as recited in claim 3 and further wherein the body is molded and is made from rubber.

5. The container holder as recited in claim 3 and further wherein the central securing section can accommodate a baby bottle and said handle portions can accommodate the hands of an infant who can hold the baby bottle for self-feeding.

* * * * *